US011362441B2

(12) United States Patent
Biscontini et al.

(10) Patent No.: US 11,362,441 B2
(45) Date of Patent: Jun. 14, 2022

(54) ULTRA COMPACT ULTRA BROAD BAND DUAL POLARIZED BASE STATION ANTENNA

(71) Applicant: HUAWEI TECHNOLOGIES CO., LTD., Guangdong (CN)

(72) Inventors: Bruno Biscontini, Munich (DE); Juan Segador Alvarez, Munich (DE); Roberto Flamini, Munich (DE); Vincent Mallepeyre, Munich (DE)

(73) Assignee: Huawei Technologies Co., Ltd., Guangdong (CN)

( * ) Notice: Subject to any disclaimer, the term of this patent is extended or adjusted under 35 U.S.C. 154(b) by 0 days.

(21) Appl. No.: 16/810,153

(22) Filed: Mar. 5, 2020

(65) Prior Publication Data

US 2020/0274256 A1 Aug. 27, 2020

Related U.S. Application Data

(63) Continuation of application No. 15/979,888, filed on May 15, 2018, now Pat. No. 10,601,145, which is a (Continued)

(30) Foreign Application Priority Data

Nov. 16, 2015 (EP) ..... 15194746

(51) Int. Cl.
*H01Q 21/26* (2006.01)
*H01Q 1/24* (2006.01)
(Continued)

(52) U.S. Cl.
CPC ..... *H01Q 21/26* (2013.01); *H01Q 1/246* (2013.01); *H01Q 1/38* (2013.01); *H01Q 9/28* (2013.01);
(Continued)

(58) Field of Classification Search
CPC ..... H01Q 21/26; H01Q 21/24; H01Q 19/005; H01Q 9/28; H01Q 1/38; H01Q 1/246; H01Q 15/14
See application file for complete search history.

(56) References Cited

U.S. PATENT DOCUMENTS 7,688,271 B2 3/2010 Cao et al.
2006/0273865 A1 12/2006 Timofeev et al.
(Continued)

FOREIGN PATENT DOCUMENTS

CN 2879454 Y 3/2007
CN 101069324 A 11/2007
(Continued)

OTHER PUBLICATIONS

European Office Action issued in European Application No. 15194746.2 dated Dec. 5, 2018, 8 pages.
(Continued)

*Primary Examiner* — Dieu Hien T Duong
(74) *Attorney, Agent, or Firm* — Fish & Richardson P.C.

(57) ABSTRACT

The invention refers to a radiating element comprising a support structure, a first dipole arranged on the support structure, and at least one electrically closed ring arranged on the support structure, wherein the ring surrounds the first dipole and is galvanically isolated from the first dipole, wherein a resonance frequency of the first dipole is higher than a center frequency of an operational bandwidth of the radiating element.

12 Claims, 8 Drawing Sheets

Related U.S. Application Data continuation of application No. PCT/EP2016/077438, filed on Nov. 11, 2016.

(51) Int. Cl.

| | |
|---|---|
| ***H01Q 21/24*** | (2006.01) |
| ***H01Q 19/00*** | (2006.01) |
| ***H01Q 9/28*** | (2006.01) |
| ***H01Q 1/38*** | (2006.01) |
| *H01Q 15/14* | (2006.01) |

(52) U.S. Cl.

CPC ..... *H01Q 19/005* (2013.01); *H01Q 21/24* (2013.01); *H01Q 15/14* (2013.01)

(56) References Cited

U.S. PATENT DOCUMENTS

| | | | | |
|---|---|---|---|---|
| 2007/0241983 | A1* | 10/2007 | Cao | H01Q 21/26 343/797 |
| 2008/0024382 | A1 | 1/2008 | Uddin et al. | |
| 2010/0182213 | A1 | 7/2010 | Obermaier et al. | |
| 2013/0113668 | A1* | 5/2013 | Kyriazidou | H01Q 19/06 343/753 |
| 2014/0125539 | A1 | 5/2014 | Katipally et al. | |
| 2015/0042533 | A1 | 2/2015 | Cheng | |
| 2017/0346191 | A1* | 11/2017 | Farzaneh | H01Q 19/028 |

FOREIGN PATENT DOCUMENTS

| | | | | |
|---|---|---|---|---|
| CN | 203386887 | U | * | 1/2014 |
| EP | 1496569 | A1 | | 1/2005 |
| JP | 2003087045 | A | * | 3/2003 |
| JP | 2009225030 | A | * | 10/2009 |
| WO | 2005122331 | A1 | | 12/2005 |
| WO | 2006059937 | A1 | | 6/2006 |
| WO | 2008017386 | A1 | | 2/2008 |
| WO | 2010018896 | A1 | | 2/2010 |
| WO | 2016090463 | A1 | | 6/2016 |

OTHER PUBLICATIONS

International Search Report and Written Opinion issued in International Application No. PCT/EP2016/077438 dated Feb. 3, 2017, 13 pages.

Office Action issued in Chinese Application No. 201680067098 dated Apr. 30, 2019, 14 pages (with English translation).

Ying Liu et al.,A Novel Miniaturized Broadband Dual-Polarized Dipole Antenna for Base Station,IEEE Antennas and Wireless Propagation Letters, vol. 12, 2013,total 4 pages.

* cited by examiner

ULTRA COMPACT ULTRA BROAD BAND DUAL POLARIZED BASE STATION ANTENNA

CROSS-REFERENCE TO RELATED APPLICATIONS

This application is a continuation of U.S. patent application Ser. No. 15/979,888, filed on May 15, 2018, which is a continuation of International Application No. PCT/EP2016/077438, filed on Nov. 11, 2016. The International Application claims priority to EP Patent Application No. EP15194746.2, filed on Nov. 16, 2015. All of the aforementioned patent applications are hereby incorporated by reference in their entireties.

TECHNICAL FIELD

The present invention relates to a radiating element, in particular, a radiating element of an antenna suitable for a base station, such as an ultra compact ultra broad dual polarized base station antenna.

BACKGROUND

Ultra broad band base station antenna systems typically operate in the 690-960 MHz ("Low Band"—LB) and 1.7-2.7 GHz ("High Band"—HB) spectrum which includes most cellular network frequency bands used today. With the growing demand for a deeper integration of antennas with Radios, e.g. Active Antenna Systems (AAS), new ways of designing ultra compact ultra broadband multiple arrays base station antenna architectures are being requested without compromising the antenna key performance indicators (KPIs). For those architectures the coexistence of multiple LB and HB arrays is a key technical point. As it is well known, this becomes even more challenging when trying to reduce the overall geometrical antenna dimensions (compact design) and keeping RF KPIs. Among many other technical design strategies, one of the key points is the radiating elements design for the LB and HB arrays. Ideally they should be electrically invisible to each other. From this perspective the physical dimensions of the radiating elements are one of the dominating factors.

WO2008/017386 A1 describes an antenna arrangement, in particular for a mobile radio base station. The antenna arrangement comprises a reflector frame with a coupling surface which is capactively coupled to a ground plane.

WO2006/059937 A1 describes a dual band antenna with shielded feeding means.

SUMMARY OF THE INVENTION

The objective of the present invention is to provide a radiating element, wherein the radiating element overcomes one or more of the above-mentioned problems of the prior art.

A first aspect of the invention provides a radiating element, the radiating element comprising a support structure, a first dipole arranged on the support structure, and at least one electrically closed ring arranged on the support structure, wherein the ring surrounds the first dipole and is galvanically isolated from the first dipole, wherein a resonance frequency of the first dipole is higher than a center frequency of the radiating element operational bandwidth.

The dipole and the ring can be arranged such that from a top view perspective the dipole and the ring are concentric (and don't overlap each other).

The design of the radiating element allows that the overall dimension of the radiating element as implemented in an ultra compact ultra broadband antenna is reduced. In particular, as the operational bandwidth of the radiating element is lower than the resonance frequency of the first dipole, the length of the dipole is actually reduced with respect to a conventional dipole antenna design.

In a first implementation of the radiating element according to the first aspect, the ring is floating. This means, the floating ring is not galvanically connected to ground or any other electric part of the radiating element. Thus, the floating ring can act as an electrical mirror for the first dipole.

In a second implementation of the radiating element according to any implementation of the first aspect, the resonance frequency of the first dipole is higher than an upper limit of the operational bandwidth of the radiating element. Hence, the electrical length of the dipole which defines the lower limit for the dimension of the radiating element in the prior art, can be reduced for the given operational bandwidth of the radiating element.

In a third implementation of the radiating element according to any implementation of the first aspect, the first dipole is arranged in a first horizontal layer and the ring is arranged in a second horizontal layer, wherein the vertical distance between the first horizontal layer and the second horizontal layer is less than 5% of the electrical length of the first dipole. The terms "horizontal" and "vertical" as used herein, are intended only to describe the relative position of the elements to each other. However, these terms are not intended to describe the orientation of the radiating element with respect to the earth's surface. The antenna element can be oriented in any position with respect to the earth's surface. The relative position of the first horizontal layer with respect to the second horizontal layer is less than 5% or, preferably less than 2%, of the electrical length of the dipole to allow that the ring can effectively act as an electrical mirror in order to reduce the total dimension of the radiating element for given operational bandwidth. Furthermore, the vertical distance between the two horizontal layers may even be zero such that the ring and the first dipole are arranged in the same layer.

In a fourth implementation of the radiating element according to any implementation of the first aspect or the first aspect as such, the support structure comprises a printed circuit board, PCB, and the first dipole is formed on a side of the PCB, and the at least one ring is formed at said side of the PCB, at an opposing side of the PCB, or in an intermediate layer of the PCB. Alternatively, the first dipole is formed in an intermediate layer of the PCB and the first ring is formed on a top or bottom surface of the PCB. The use of the PCB as a supporting structure in accordance to this implementation allows an easy manufacture of the radiating element. Moreover, since the thickness of the PCB is typically very small in comparison to the length of the dipole, the PCB also allows realizing the preferred distances between the dipole and the ring in its horizontal distance as defined in the third implementation.

In a fifth implementation of the radiating element according to any implementation of the first aspect or the first aspect as such, the radiating element has a second electrically closed ring arranged on the support structure, wherein the second ring surrounds the first dipole and is galvanically isolated from the first dipole. The second ring may also act as an electrical mirror for the first dipole and contribute to reduce the dimensions of the radiating element for a given operational bandwidth.

In a sixth implementation of the radiating element according to the fifth implementation, the second ring is arranged in a third horizontal layer having a vertical distance to a first layer, in which the first dipole is arranged, not more than 5% of the total length of the first dipole. The position of the second ring is preferably symmetrical to the first ring (from a top view perspective overlapping the first ring) in order to contribute to the technical effect of reducing the radiating element's dimensions.

In a seventh implementation of the radiating element according to the fifth or sixth implementation, the support structure is a printed circuit board, PCB, and the first ring is formed on a top side of the PCB and the second ring is formed on a bottom side of the PCB. This implementation allows an easy manufacture of the radiating elements similar to the fourth implementation. It is an advantage that in this implementation the first and second rings can be easily arranged symmetrically to each other with only a short vertical distance between the rings. The vertical distance is defined by the thickness of the PCB.

In an eighth implementation of the radiating element according to any implementation of the first aspect, the radiating element is configured to be mounted on a reflector and further comprises a further support structure configured to elevate the support structure over the reflector, when the radiating element is mounted on the reflector. The further support structure of this implementation is mechanically conducted to the support of the structure of the first dipole and/or the first ring. Thus, the further support structure is configured to space the support structure carrying the radiating element from the reflector.

In a ninth implementation of the radiating element according to the eighth implementation, the further support structure comprises a first pair of dipole feet, wherein the first pair of dipole feet has at least 4 electrical or capacitive connecting points to the first dipole. In comparison to only one connecting point for each foot, the two electrical capacitive connecting points provide better efficiency to drive the dipole. The connecting points may include a solder joint which is either directly galvanically connected to the first dipole or capacitively connected to the first dipole. For example, both solder joints for each dipole foot can be separated by a gap from the respective dipole arm such that the connecting points are capacitively connected to the respective dipole arm. Both the direct electrical connection and the capacitive connection provide an efficient way to drive the dipole.

In a tenth implementation of the radiating element according to any implementation of the first aspect, a second dipole is arranged on the support structure in a same horizontal layer with the first dipole and the length extension of the second dipole is oriented perpendicular to a length extension of the first dipole. The second dipole allows to radiate in a second orthogonal polarization state with respect to the first dipole. By selecting a particular phase shift between the first and second dipole, linear polarized radiations in any orientation or circular polarized radiation in clockwise and anti-clockwise rotation as well as elliptical polarized radiation can be generated.

In an eleventh implementation of the radiating element according to the tenth implementation of the first aspect, the radiating element comprises for the first dipole a first pair of dipole feet and for the second dipole a second pair of dipole feet, which are arranged perpendicular to each other, in particular, the first and second pairs of dipole feet, respectively, are formed by a first and a second printed circuit board, PCB, that are stuck together. Forming the dipole feet on printed circuit boards which are arranged perpendicularly to each other allows an easy manufacture of the dipole feet and an easy connection to the respective first and second dipoles. Moreover, sticking the PCBs together allows to electrically separating the pairs of dipole feet for connection to the first and second dipole, respectively.

In a twelfth implementation of the radiating element according to any of the fifth to eleventh implementation of the first aspect, the dipole feet of the first and/or second pair of dipole feet are galvanically or capacitively connected with the first and/or second dipole. Preferably, each of the first and second pairs of dipole feet has at least four electrical or capacitive connecting points to the first and second dipole, respectively, which ensures an efficient coupling as mentioned for the first dipole feet in connection with the eighth implementation.

In a thirteenth implementation of the radiating element according to any of the ninth to twelfth implementation of the first aspect, the dipole feet of the first and/or second dipole are arranged in two vertical layers, preferably with reference to the tenth implementation, on the top and bottom surface of the vertical PCBs, wherein one layer of the first and/or second dipole feet is planar conductive and the second layer of the first and/or second dipole feet includes a conducting path having a general U-shaped form over the respective pair of dipole feet. This provides an efficient design for driving the first and/or second dipole and is easy to manufacture as the vertical PCBs provide surfaces for the first and second vertical layers of the respective pair of dipole feet. The planar conductive layer of each dipole foot acts as a mirror for the U-shaped conductive path of the second layer.

In a fourteenth implementation of the radiating element according to any implementation of the first aspect, the first ring and/or, with reference to the third implementation, the second ring has a general quadratic shape. This allows a compact design of the radiating element.

In a fifteenth implementation of the radiating element according to any implementation of the first aspect when depending on the third implementation, the first and second ring have the same shape. Hence, the first and second rings act symmetrically to provide a symmetric radiation field.

In a sixteenth implementation of the radiating element according to the first aspect, the first and/or the second dipole include each two opposing dipole arms. Furthermore each two opposing dipole arms can be in the form of two opposing quadratic fields having a recess on the two outer corners of the two opposing quadratic fields. This allows a compact design of the radiating element.

BRIEF DESCRIPTION OF THE DRAWINGS

To illustrate the technical features of embodiments of the present invention more clearly, the accompanying drawings provided for describing the embodiments are introduced briefly in the following. The accompanying drawings in the following description are merely some embodiments of the present invention, but modifications on these embodiments are possible without departing from the scope of the present invention as defined in the claims.

DETAILED DESCRIPTION OF THE EMBODIMENTS

Figure 1:
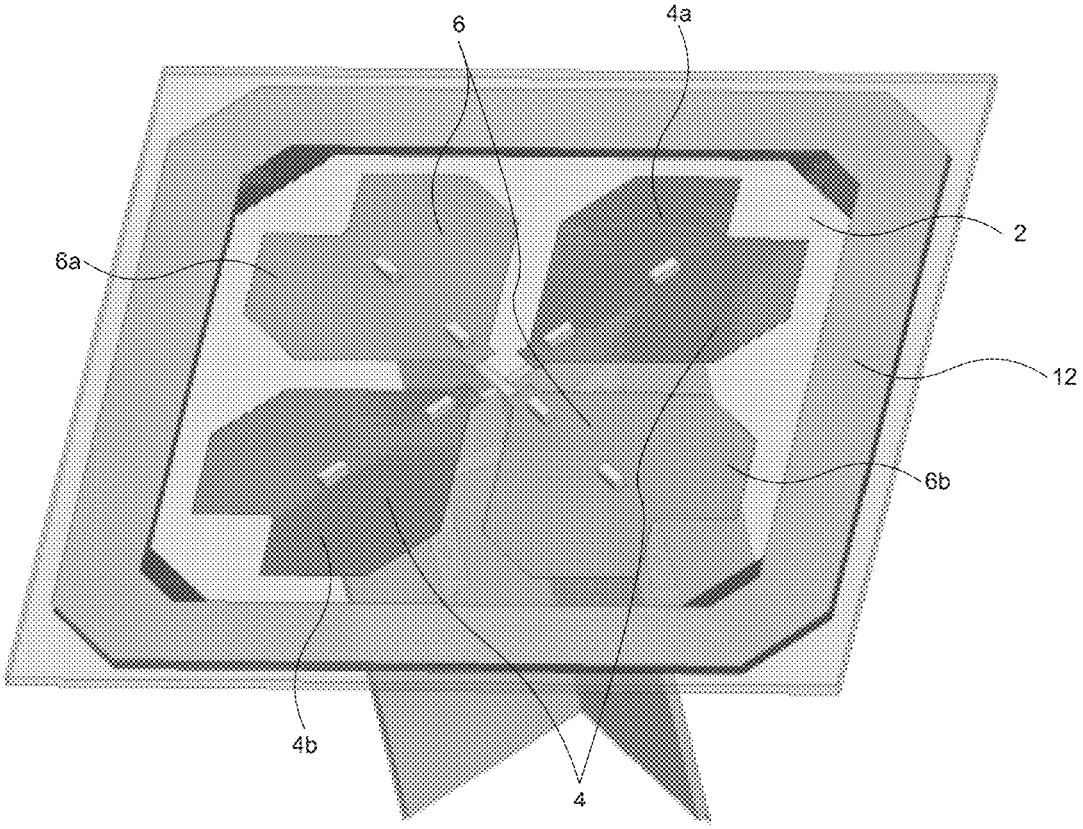
FIG. 1 shows a perspective view of a radiating element.
Figure 2:
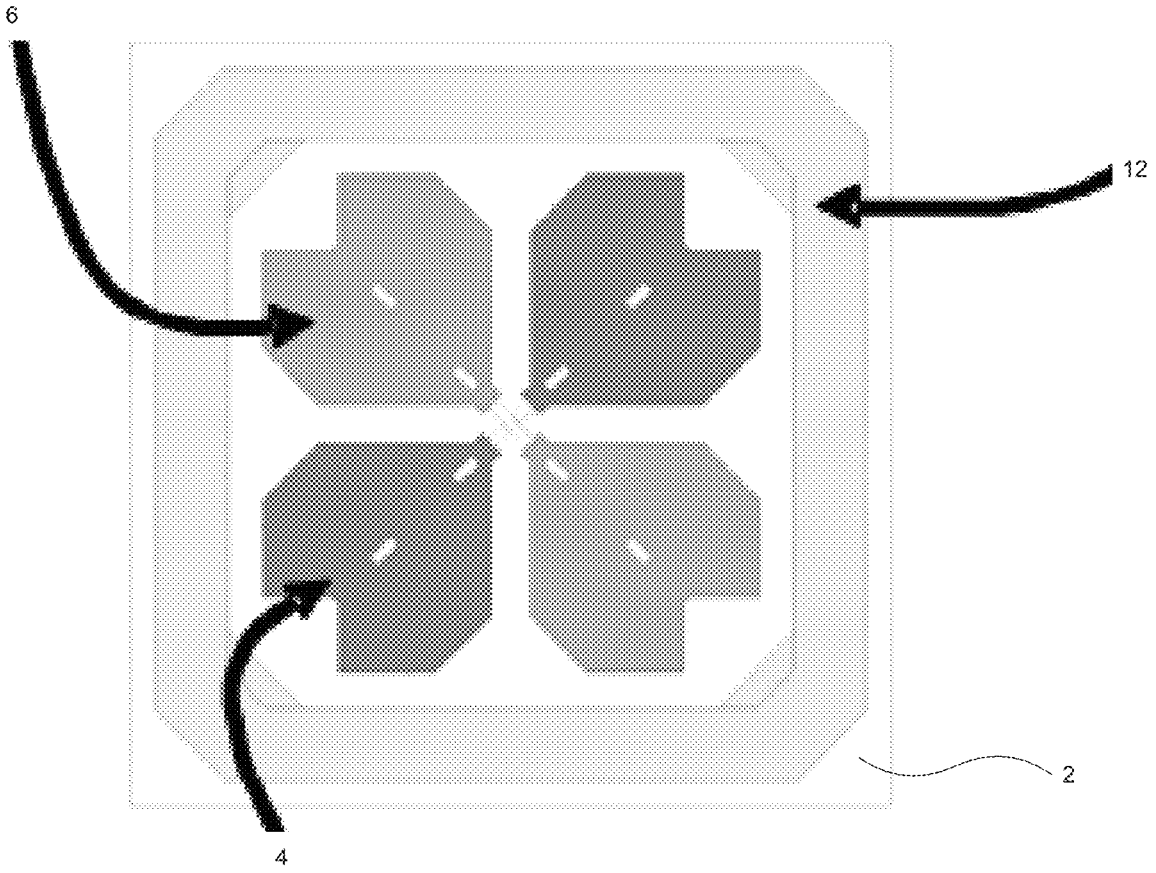
FIG. 2 shows a top view of the radiating element of FIG. 1.
Figure 3:
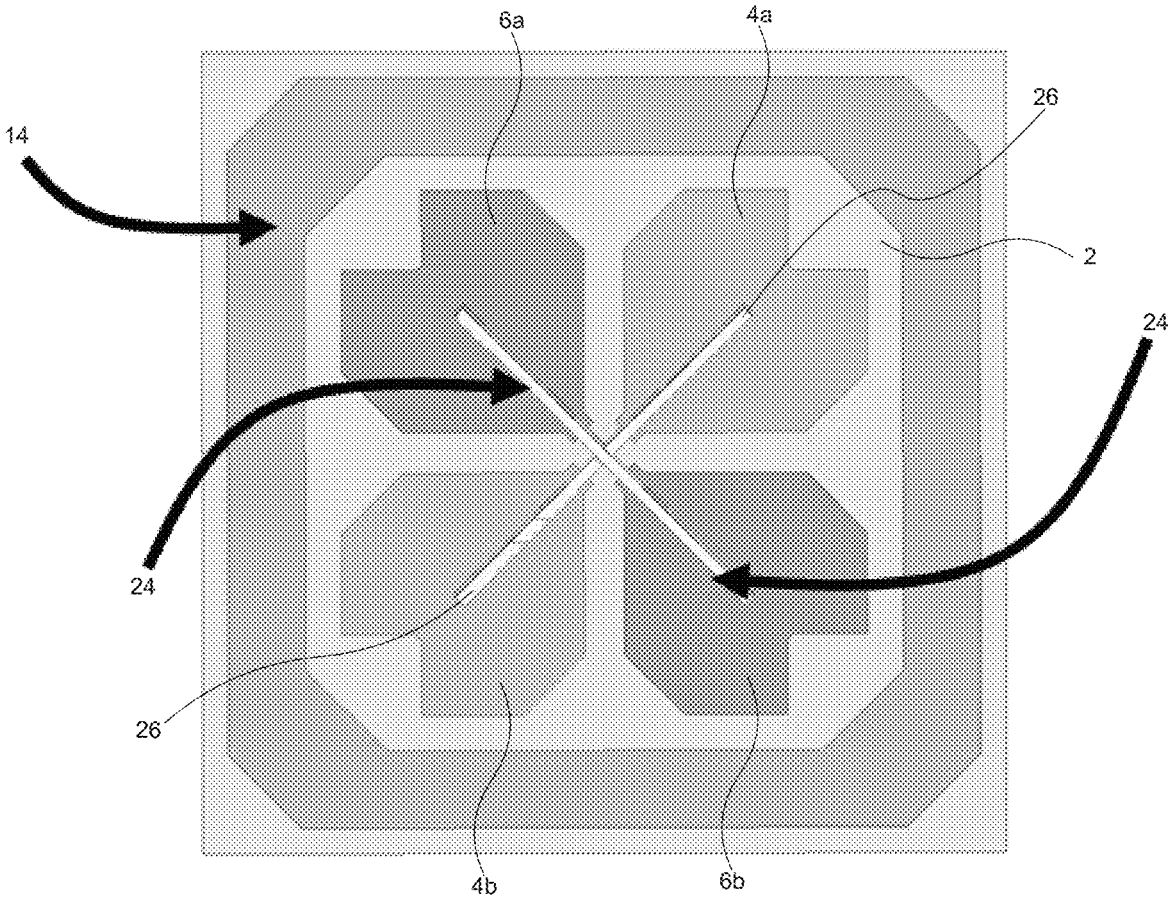
FIG. 3 shows a bottom view of the radiating element of FIG. 1.
Figure 7:
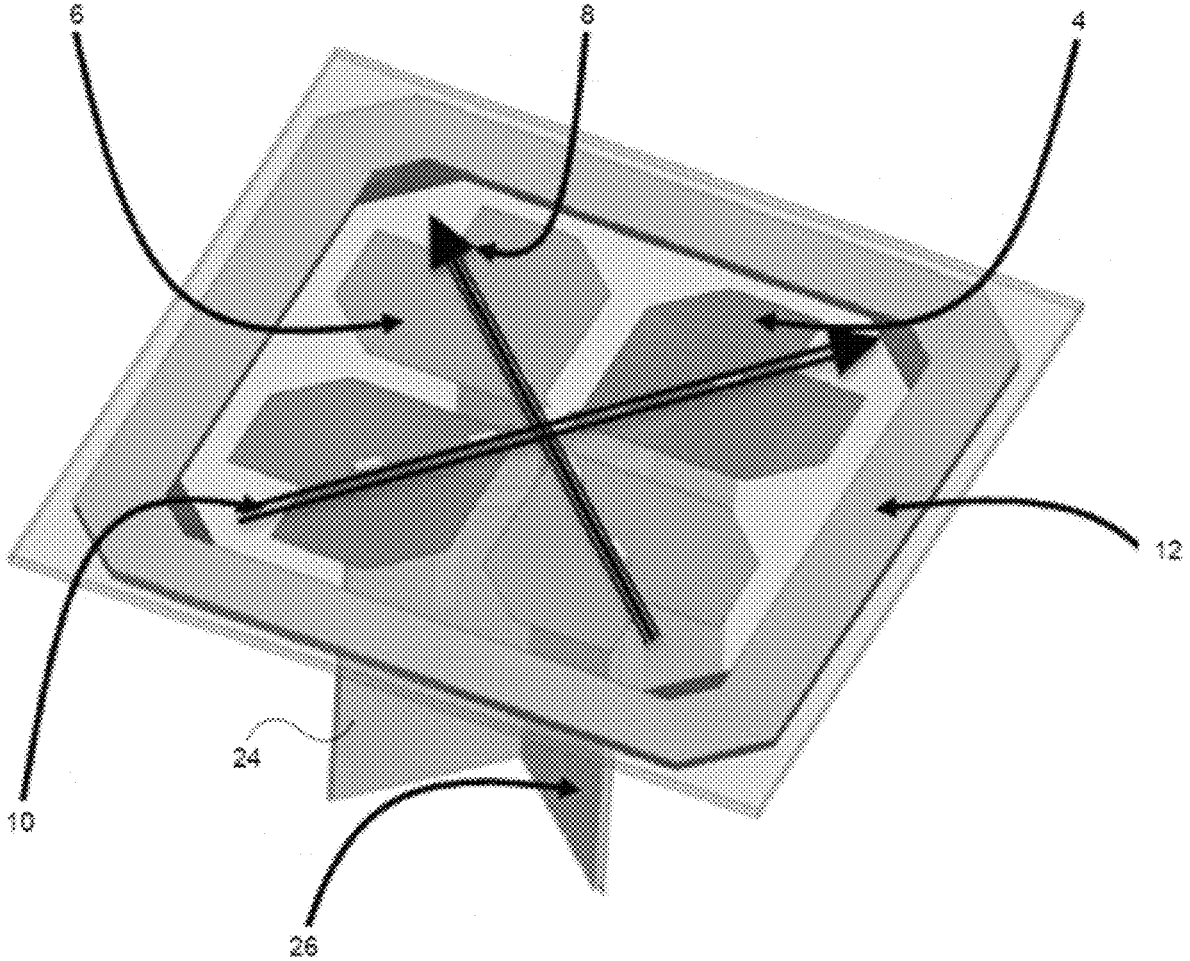
FIG. 7 shows a perspective view of the radiating element of FIG. 1 indicating electrical polarisations of the first and second dipoles.

With reference to FIGS. 1 to 3 an embodiment of a radiating element is described. The radiating element includes a support structure 2 in the form of a quadratic PCB. On the top surface of the PCB 2 first and second dipoles 4 and 6 are located on a single layer. The first dipole 4 includes two opposing dipole arms 4*a*, 4*b*. The second dipole 6 includes two opposing dipole arms 6*a*, 6*b*. Just for illustration purposes, the PCB 2 is illustrated as transparent. The dipoles 4 and 6 are arranged perpendicular to each other. With reference to FIG. 7, an example of an electric polarisation of the dipole elements is indicated by arrows 8 and 10. A skilled person will understand that the dipoles can include any phase shift such that any linear or circular or elliptical polarized radiation field can be radiated from the radiating element.

The top surface of the PCB 2 also includes a ring 12 which in the present embodiment has the form of a square wherein the edges of the square are cut into a diagonal. The top ring 12 surrounds the first and second dipole 4 and 6 completely. Moreover, the top ring 12 is galvanically separated from the dipoles 4 and 6 as well as from all other electrical parts of the radiating element. Hence the top ring 12 is floating.

On the bottom surface of the PCB 2, as shown in FIG. 3, a second electrical ring 14 is located which also surrounds the first and second dipoles 4 and 6. The second ring 14 is also galvanically separated from ground and from any other electrical parts of the antenna element. It should be noted that the dipoles 4 and 6 as shown in FIG. 3 (which can be seen due to the transparent illustration of the PCB 2) are the same as the ones shown in FIG. 1 the dipoles 4 and 6 are only arranged on one side (in this case the top side) or layer of the PCB. However, the diploes 4 and 6 could also be arranged on another layer or even on different layers of the PCB.

The vertical distance of the first ring 12 and the second ring 14 is only defined by the thickness of the PCB 2. In general, the vertical distance between the first and second ring 12 and 14 as well as the vertical distance with respect to the layer of the first and second dipoles 4 and 6 is very small (less than 5% or 2%) in comparison to the length of each of the dipoles 4 or 6 in their horizontal extension.

Furthermore, it can be seen that neither the first ring 12 nor the second ring 14 overlap with the dipoles 4 and 6, when seen from the top or bottom view.

The construction of the ring structure surrounding the dipole structure maintains an ultra broad band characteristic of an antenna while reducing the radiation surface compared to radiating elements without such an additional ring structure. By this means, the dipoles manage to shift the frequency since the dipoles resonate out of the useful band of the LB and the HB is electrical invisible to the LB or vice versa. The top and bottom rings 12 and 14 provide an additional resonating structure to the dipole elements, hence, increasing the operating frequency of the radiating element. The rings 12 and 14 remain invisible to the LB array as they are not directly connected to ground. A further advantage is that the rings are integrated on the same carrier structure, namely the PCB 2, such that no additional part are required to mechanically connect the rings 12, 14 on the radiating element.

Figure 4:
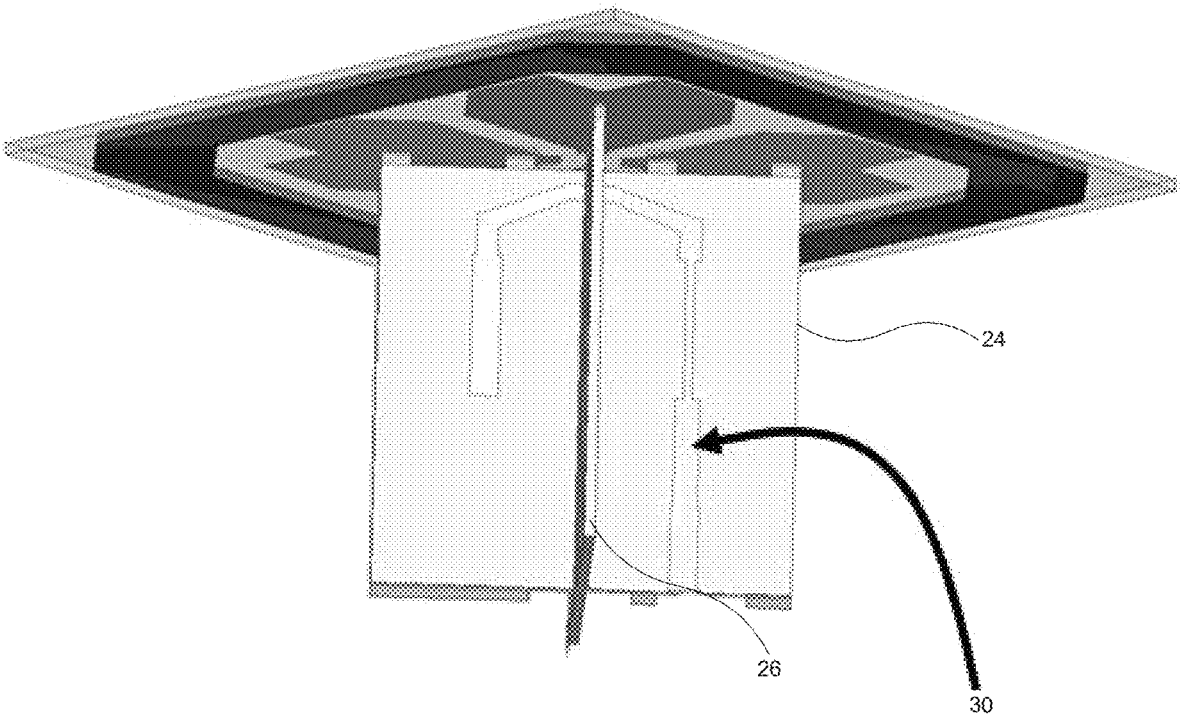
FIG. 4 shows a perspective view of a radiating element of FIG. 1 from the bottom side.
Figure 5:
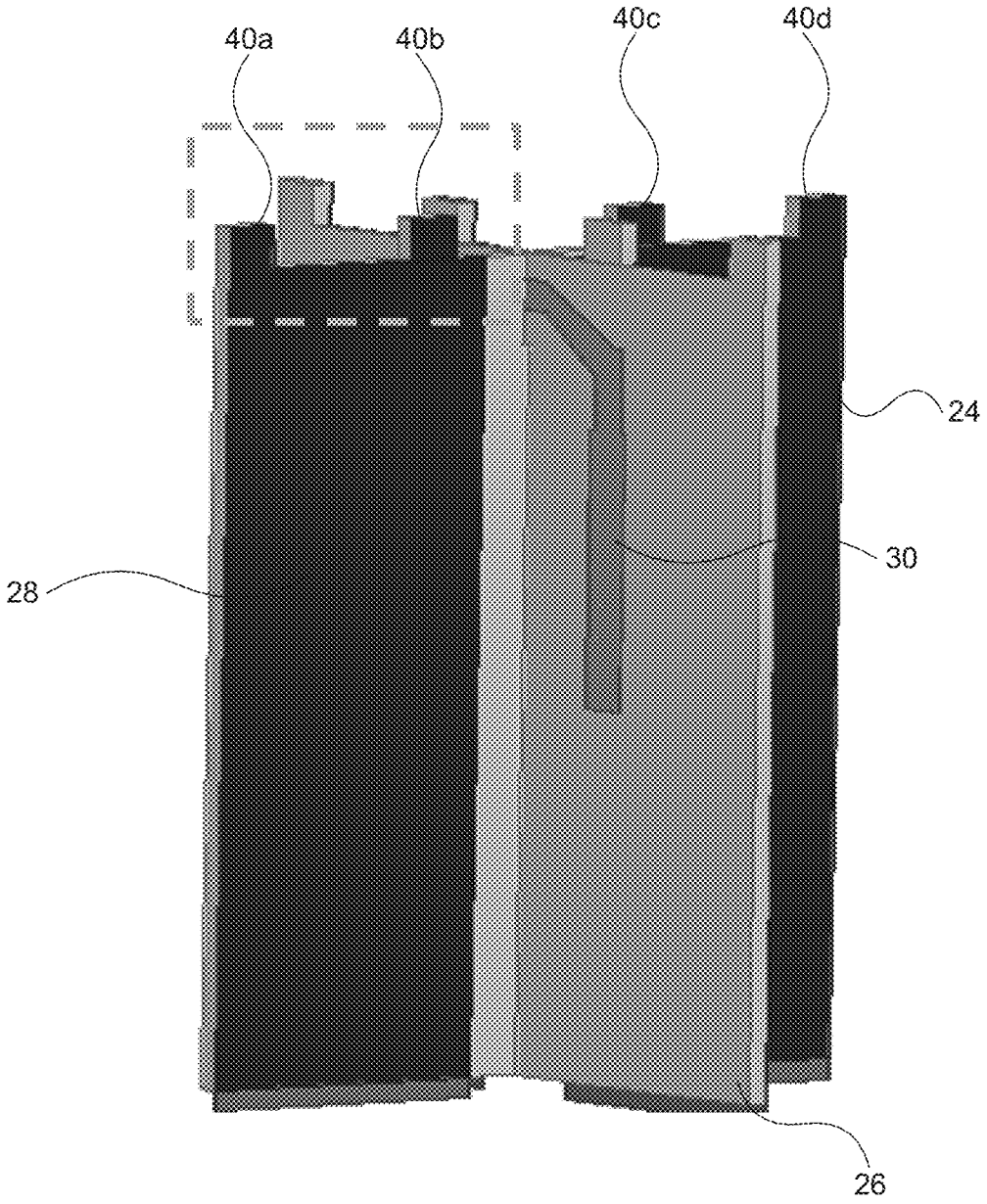
FIG. 5 shows a perspective side view of only the dipole feet of the radiating element of FIG. 1.
Figure 8:
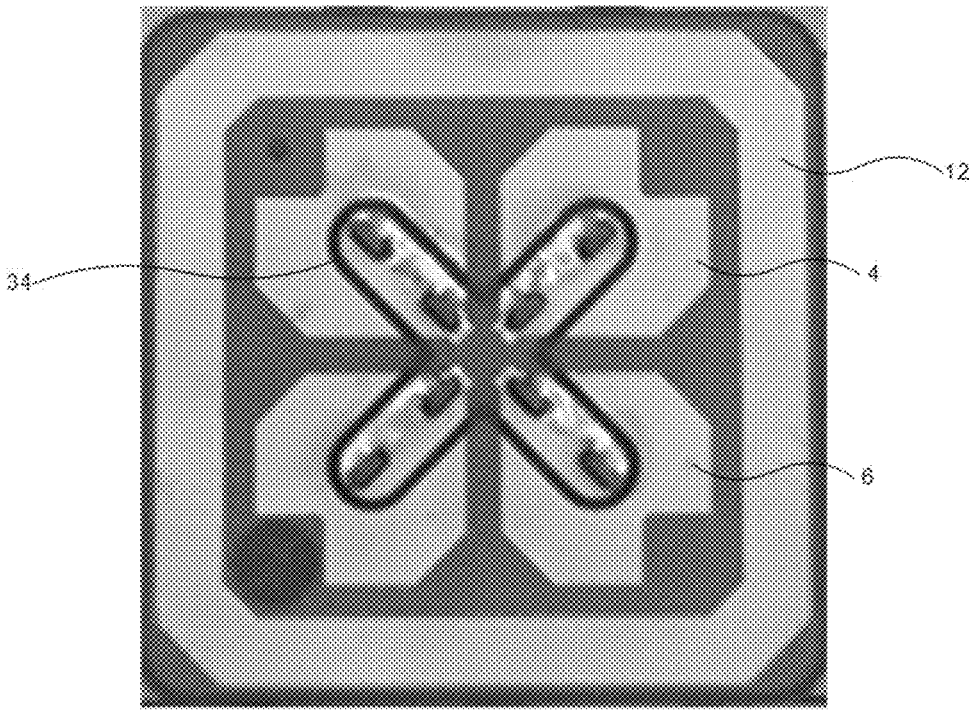
FIG. 8 shows a top view of a further radiating element.

With reference to FIGS. 3 to 5 a foot structure of the radiating element is described. Each of the dipoles 4 and 6 is connected with a pair of dipole feet 24 and 26. The pairs of dipole feet 24 and 26 each include a single PCB which are stacked together as shown in FIG. 5. On the front end of the PCBs of the dipole feet 24 and 26, respectively, each PCB includes four connecting points in form of four soldering tags 40*a*, 40*b*, 40*c*, 40*d* which are inserted in respective slots in the first and second dipole 4, 6 as shown in the top view of FIG. 2. Thus, each dipole foot is connected by two connecting points to the respective dipole arm. As shown in FIGS. 3 and 4, the soldering tags of the dipole feet are directly galvanically connected to the respective dipole. FIG. 8 shows another top view on radiating element according to an embodiment of the present invention. Also this radiating element comprises two cross polarized dipoles 4 and 6 and a floating top ring 12 surrounding the two dipoles 4, 6. The dipoles 4, 6 and the top ring are arranged on the same PCB layer as the top ring 12. Furthermore, a solder stop 34 is shown in Figure used to avoid solder material for the soldering tags spill over the PCB. However, the metal material of the dipoles 4 and 6 is continuous below the solder stop 34.

Each dipole feet 24 and 26 shown in FIGS. 4 and 5 includes a PCB which is planar conductive on one side 28 and include a general U-shaped conductive path 30 on the opposing side. The planar conductive side 28 which is also galvanically connected to the mentioned soldering tags of each dipole feet 24, 26 will typically be connected to ground. The conductive path 30 of each of the dipole feet 24, 26 will typically be connected to be connected to an RF signal source.

Figure 6:
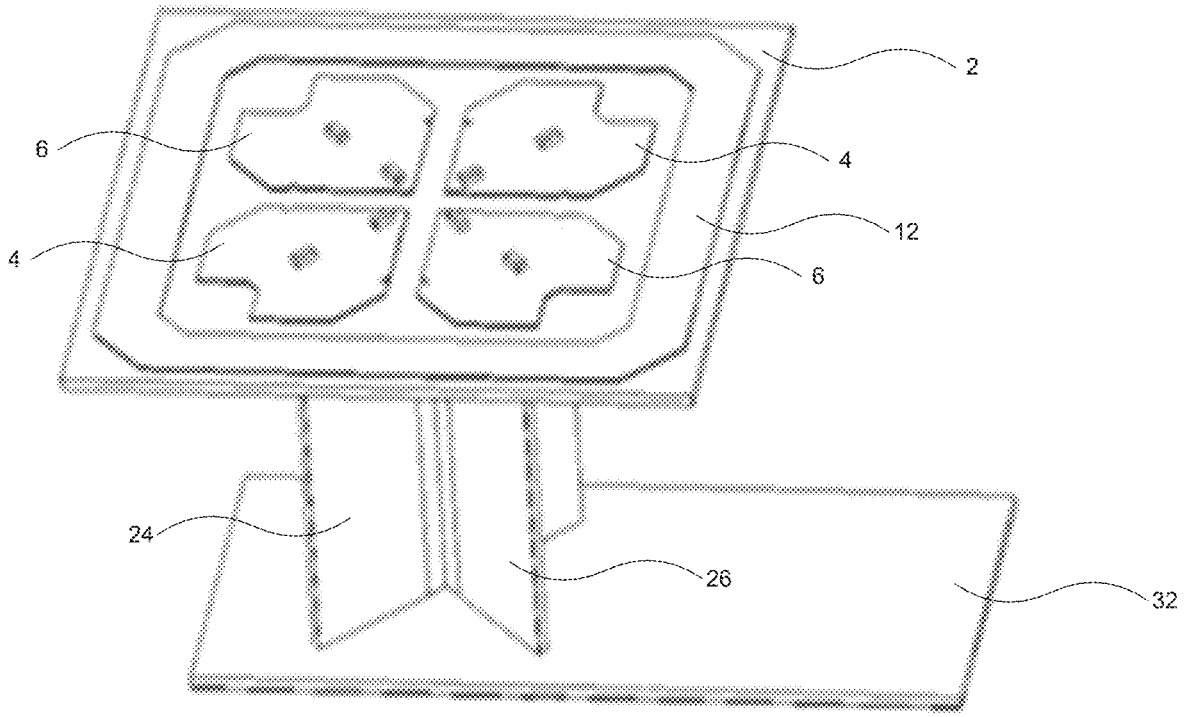
FIG. 6 shows a perspective view of a radiating element of FIG. 1 mount on a supporting structure.

With reference to FIG. 6, the radiating element is shown mounted on a surface structure 32 which may include also a PCB (e.g. for mounting on a reflector board). As can be seen from FIG. 6, the pairs of dipole feet 24 and 26 provide for a defined distance between the supporting structure 2 and a reflector board. Thus, the radiating element can be easily installed in an antenna structure. It should be understood that multiple of the radiating elements can be installed on a reflector next to each other in a single base station antenna structure.

It is implicit that all the previous descriptions are still valid for a single polarized radiating element, which would include a single dipole instead of two; indeed the principle behind the electromagnetic coupling between ring and dipole remains valid. Hence, further embodiments of the present invention provide radiating elements with only one dipole or even with more than two dipoles.

The foregoing descriptions are only implementation manners of the present invention and the protection of the scope of the present invention is not limited to this. Any variations or replacements can be easily made through person skilled in the art. Therefore, the protection scope of the present invention should be subject to the protection scope of the attached claims.

The invention claimed is:

1. A radiating element, comprising:

a support structure having a first horizontal layer and a second horizontal layer;

a first dipole and a second dipole arranged on the first horizontal layer, the first dipole is placed in a +45 degree polarization direction, and the second dipole is placed in a −45 degree polarization direction; and a first electrically closed ring arranged on the first horizontal layer or the second horizontal layer, wherein the first electrically closed ring surrounds the first dipole and the second dipole from a top or bottom view, and is galvanically isolated from the first dipole and the second dipole, wherein the first electrically closed ring is floating, wherein the first electrically closed ring has a form of a square, and wherein a first planar dipole arm of the first dipole has a groove on an outer corner of the first planar dipole arm.

2. The radiating element of claim 1, wherein a resonance frequency of the first dipole is higher than a center frequency of an operational bandwidth of the radiating element.

3. The radiating element of claim 1, wherein a resonance frequency of the first dipole is higher than an upper limit of an operational bandwidth of the radiating element.

4. The radiating element of claim 1, wherein a vertical distance between the first horizontal layer and the second horizontal layer is less than 5% of an electrical length of the first dipole.

5. The radiating element of claim 1, further comprising a second electrically closed ring arranged on the support structure, wherein the second electrically closed ring surrounds the first dipole and the second dipole, and is galvanically isolated from the first dipole and the second dipole.

6. The radiating element of claim 5, wherein the second electrically closed ring is arranged in a third horizontal layer of the support structure having a vertical distance to the first horizontal layer, in which the first dipole and the second dipole are arranged, not more than 5% of a total length of the first dipole.

7. The radiating element of claim 5, wherein the support structure is a printed circuit board (PCB), and wherein the first electrically closed ring is formed on a top side of the PCB and the second electrically closed ring is formed on a bottom side of the PCB.

8. The radiating element of claim 1, wherein the radiating element is configured to be mounted on a reflector and further comprises:

a further support structure configured to elevate the support structure over the reflector, when the radiating element is mounted on the reflector.

9. The radiating element according to claim 8, wherein the further support structure comprises a first pair of dipole feet, and wherein the first pair of dipole feet has at least 4 electrical or capacitive connecting points to the first dipole.

10. The radiating element of claim 1, wherein edges of the square are cut into a diagonal.

11. The radiating element of claim 10, further comprising for the first dipole a first pair of dipole feet and for the second dipole a second pair of dipole feet, which are arranged perpendicular to each other, wherein the first and second pairs of dipole feet, respectively, are formed by a first and second printed circuit boards (PCBs) that are stuck together.

12. The radiating element of claim 11, wherein at least one of the first or the second pair of dipole feet are galvanically or capacitively connected with at least one of the first dipole or the second dipole.

* * * * *